United States Patent [19]

Gawlick et al.

[11] 4,036,103

[45] July 19, 1977

[54] MAGAZINE APPARATUS FOR PROPELLANT CHARGES AND METHOD OF MAKING SAME

[75] Inventors: Heinz Gawlick, Vagen Post Feldkirchen-Westerham; Horst Rammensee, Nurnberg; Karl Mack, Ansbach; Fritz Schneider, Burgbernheim, all of Germany

[73] Assignee: Dynamit Nobel Aktiengesellschaft and Impex-Essen Vertrieb Von Werkzeugen GmbH, Germany

[21] Appl. No.: 540,242

[22] Filed: Jan. 10, 1975

[30] Foreign Application Priority Data

Jan. 19, 1974 Germany ..... 2402553

[51] Int. Cl.[2] ..... F42B 39/08

[52] U.S. Cl. ..... 89/35 R; 102/86.5

[58] Field of Search ..... 89/35 R, 33 BB, 33 C, 89/161; 102/86.5; 42/87–89

[56] References Cited

U.S. PATENT DOCUMENTS

| | | | |
|---|---|---|---|
| 928,344 | 7/1909 | Swahn | 89/35 R |
| 1,334,052 | 3/1920 | Putnam | 89/161 U X |
| 1,429,370 | 9/1972 | Putnam | 89/161 X |
| 3,538,636 | 11/1970 | Roth | 42/87 |
| 3,590,684 | 7/1971 | Gilbert | 89/35 R |
| 3,611,870 | 10/1971 | Udert et al. | 102/86.5 X |
| 3,625,154 | 12/1971 | Gawlick et al. | 102/86.5 |
| 3,673,917 | 7/1972 | Myers | 89/161 X |
| 3,762,328 | 10/1973 | Rocha | 89/35 R |

*Primary Examiner*—David H. Brown

*Attorney, Agent, or Firm*—Craig & Antonelli

[57] ABSTRACT

Magazine apparatus for accommodating propellant charges including a flat coilable metal strip having a plurality of holes extending transversely therethrough for accommodating insertion of cartridges. Cartridge holding collars are formed at each of the holes by bulging or plastically deforming the strip in the region of these holes so as to form a clamping seat spaced from the plane of the strip for clampingly engaging cartridges held at the strip. Various preferred embodiments include various cross-sectional configurations of the holding collars. The method of making the magazine apparatus includes forming the collars by a multiple-step bulging process wherein the last bulging steps is formed by the cartridges as they are inserted into position on the strip.

15 Claims, 6 Drawing Figures

MAGAZINE APPARATUS FOR PROPELLANT CHARGES AND METHOD OF MAKING SAME

BACKGROUND AND SUMMARY OF THE INVENTION

The invention relates to magazine apparatus for propellant charges or cartridges, optionally combined with bolts, projectiles, or the like, for commercial and/or military purposes. More particularly, the invention relates to such magazine apparatus in the form of a coilable strip of metal, provided with spaced-apart recesses for receiving respectively one propellant charge, as well as to a process for the production thereof.

It has been known from DAS (German Published Application) No. 2,049,837 to provide a flexible, smooth magazine belt of a synthetic resin with recesses arranged at mutual intervals, and to hold the propellant cartridges in these recesses by means of a clamping seat. The plastic belts are sufficiently elastic to hold the propellant cartridges by a clamping mounting during storage and handling, in spite of the diameter tolerances of the recesses and propellant cartridges unavoidable in mass production. However, as was found under practical conditions, the strength of these coilable plastic strips is insufficient to ensure the flawless mounting of the cartridges in each case also during firing. These strips are produced by the extrusion method and are optionally subsequently stretched. Thereby, the synthetic resin in the strip is longitudinally oriented which, in turn, results in a reduced strength in the transverse direction. Also the punching of the recesses reduces this strength. Therefore, during firing, the magazine belt was found to rupture along its length, leading to loading distrubances in the stud driving tool, cattle stunning apparatus, or firing devices of other types and thus undesirably impaired the handling of these devices.

These disadvantages are avoided in the magazine strip of metal, which can be wound up, as known from DOS (German Unexamined Laid-Open Application) No. 2,216,022 (corresponding to commonly assigned pending U.S. Pat. application Ser. No. 346,893, filed Apr. 2, 1973). However, since a metallic strip is of relatively low elastic expandability in the direction of its flat extension, as compared to a synthetic resin elastic strip, so that a simple clamping mounting in correspondence with the aforementioned plastic strip magazine is insufficient due to the unavoidable manufacturing tolerances, additional tubular casings have been provided which are pushed onto the propellant cartridges and which are held by a frictional connection to the rim fire cartridges, or the like passed through the cutouts and contacting the strip with their projecting bottom rims. In this way, the propellant charges are flawlessly joined to the metallic strip also during firing, but the expenditure incurred to achieve this objective is relatively high, since the casings must be manufactured in a separate process, and the joining of the individual parts is relatively cumbersome and time-consuming.

The present invention is based on the problem of avoiding the above disadvantages in a magazine of the type described above, i. e. to fashion this magazine so that, with a flawless functioning, it is also maximally simple in manufacture and assembly, even under adverse conditions.

In order to solve this problem, the invention provides that the cutouts exhibit a holding collar produced by bulging (plastically deforming) the strip in the zone of the holes or cutouts. With its inner surface, this holding collar contacts the propellant charges or cartridges disposed in the cutouts along the entire periphery of these charges in the manner of a clamping seat. The propellant charges, which can be very simply inserted by pressure into the cutouts, generally have a special cartridge case of metal or plastic. However, it is also contemplated by the invention to use propellant charges without a cartridge case, i. e. so-called caseless propellant charges. The annular holding collar projecting from the flat strip can advantageously be deformed elastically much more easily than the strip in its flat extension. Therefore, the propellant charges are securely held in the collar by a clamping seat since the charges place the holding collar in the tangential and radial directions under tensile stress.

According to the invention it is contemplated to produce the holding collar before the cutouts are prepared, or simultaneously therewith, or also subsequently thereto by a bulging process. In any event, care must be taken that during this deformation the rim of the holding collar is not torn. This can be obtained especially simply according to a preferred form of the invention by first conducting the bulging step and thereafter producing the cutout, e. g. by punching, in the zone of the bulge. However, two separate working steps are required for this purpose. In contrast thereto, if the bulging (expanding) step is conducted, for example, simultaneously with the punching process or subsequently to the latter, the so-called drawing force—at which the rim of the cutout is bulgingly expanded without tearing—must be adapted, with respect to its magnitude, the number of deformation steps, etc., to the deformability of the strip, especially the hardness thereof.

To further improve the clamping mounting, a suitable further embodiment of the invention provides to fashion the holding collar so that it has a spring-back resilience. For this purpose, the metallic strip is produced of a springy material, preferably a hard-rolled aluminum alloy, such as, for exaample Al Mg Si 1 — F 37. However, the strip could also be manufactured, for example, of an elastic copper alloy or a rustproof steel band. The initial hardness of the strip, the strengthening during the perforation and rim formation, as well as the modulus of elasticity of the strip material are brought in conformance with the shape of the holding collar so that an optimum spring-back resilience of the holding collar results in a maximally advantageous clamping seat for the propellant charges. The resilient construction of the strip moreover has the additional advantage that it can be coiled up without kinks. In view of the stresses occurring in the strip, a material free of corrosive stresses is also preferably employed for the strip.

According to another suggestion of this invention, the holding collar contacts the propellant charges essentially only with its forward zone. The holding collar is fashioned, for this purpose, for example with an inside cross section which becomes smaller toward its end face, so that the propellant charges are contacted by the collar essentially only with its inner rim formed at the transition from the inner surrounding surface to the end face and with a small adjoining area of the surrounding surface. During the elastic expansion of the holding collar caused by the propellant charges, the coller is, so to speak, elastically bent away toward the outside at the transition into the flat strip, whereby the spring-back effect can be advantageously enhanced.

When using propellant charges with cartridge cases, which are preferably made of metal, the invention provides the further possibility of fashioning the holding collar at the transition from its inner surrounding surface toward the end face with a sharp-edged or finned inner rim contacting the propellant charge case. Thereby, the clamping seat during firing can be still further improved, in that the case, under the pressure action of the propellant gases, is expanded to a minor extend in its zone extending from the holding collar, and thus the inner rim of the holding collar is forced into the case, so that an additional frictional connecton is obtained between the holding collar and the case. The sharp inner rim and/or the fin at this rim can be shaped by the punching tool and by the way the punching step is executed, to satisfy the requirements of each individual case.

Insofar as there is the danger that, due to excessive local pressure effects in the zone of the end face of the holding collar, caseless propellant charges are damaged or even destroyed already prior to firing, and/or the cases of propellant charges are unduly affected, depending on their design and the firing device employed, before or during firing, another suggestion of this invention provides that the holding collar is bent toward the outside in the zone of its end face, preferably by round flanging. This additional shaping step additionally retains the strength of the holding collar, which can be of advantage during firing, depending on the mechanical and thermal stresses.

Depending on the degree of bulging and the deformability of the strip material, it can prove to be suitable or necessary, in view of a tear-free formation of the holding collar, to subdivide the process of bulging the strip in the zone of the cutouts to produce the annular holding collar into at least two deformation steps. To keep the manufacturing expenses at a miniumum during this procedure, the present invention provides a mode of operation wherein the last bulging step is accomplished by means of the propellant charge cases themselves when pressed into the cutouts. The cutouts proper can be produced only immediately before this last step or also already in an earlier production stage, for example by punching. Due to the plastic deformation of the holding collar occurring during the last bulging step, the collar adapts itself to the cartridge configuration so to speak automatically; consequently, larger manufacturing tolerances are permissible in an advantageous manner. Of course, the cartridge case, in this method, must have such a dimensional stability that it is not itself permanently deformed in an undesirable way during this procedure.

The bulges projecting according to this invention from the flat surface of the strip to form an annular holding collar effect a rigidification of the strip, making it difficult to wind up the latter. This can be counteracted if necessary, for example, by increasing the spacings of the cutouts and/or by reducing the size of the holding collars.

These and other objects, features and advantages of the present invention will become more apparent from the following description when taken in connection with the accompanying drawing which shows, for purposes of illustration only, several embodiments in accordance with the present invention.

DETAILED DESCRIPTION OF THE DRAWINGS

Figure 1:
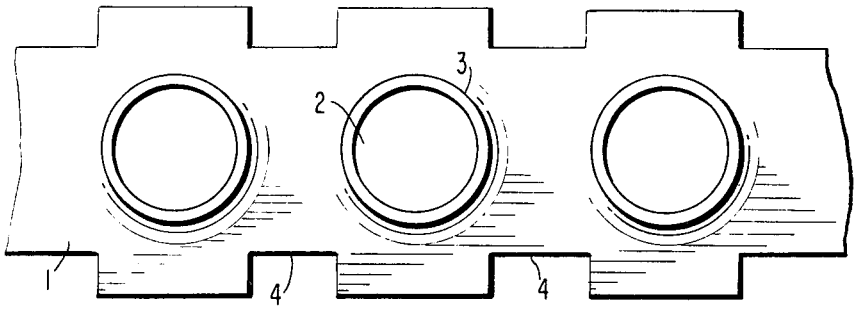
FIG. 1 is a top plan view which shows a section of a magazine strip, without propellant charges, constructed in accordance with the present invention.

According to FIG. 1, the coilable strip 1 of metal, which can be manufactured in practically any desired length, is shown with the cutouts 2 provided at equal spacings from one another, and with the annular holding collars 3 surrounding these cutouts. The lateral recesses 4 provided along the sides at regular intervals serve, as is conventional, for the feeding of the magazine strip within the firing device.

FIGS. 2 – 6 show in each case a longitudinal section through a single cutout of the strip. In the embodiment shown in FIG. 2, the strip 1 is provided in the zone of the cutout 2 with the relatively low holding collar 3 which contacts, with its inner rim 5 between its inner surrounding surface 6 and its end face 7, the propellant charge 8 with a cartridge case crimped at the tip. The rim 5 is sharp-edged. However, instead, the rim could also have a fin, for example, which is not shown.

Figure 3:
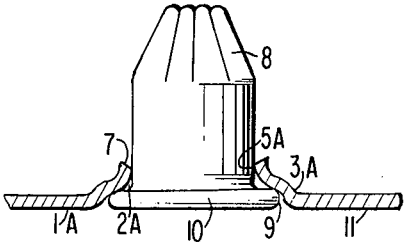

According to the FIG. 3 embodiment, the strip 1A is provided in the zone of the cutout 2A with an additional embosses portion 9 so that the propellant charge 8 does not project with its bottom rim 10 beyond the underside 11 of the strip 1A. Here again, the holding collar 3A contacts with its inner rim 5A the propellant charge 8 in the manner of a clamping seat.

Figure 2:
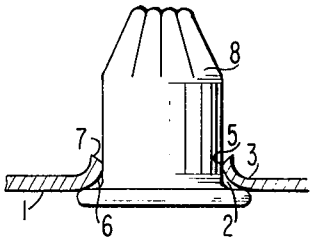
FIGS. 2 – 5 are longitudinal partial sectional views illustrating respective different preferred embodiments of magazine apparatus, with propellant cartridges, constructed in accordance with the present invention.
Figure 4:
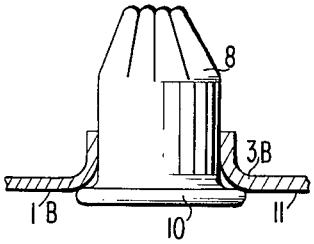

In FIG. 4, an embodiment of a holding collar 3B having a greater height is illustrated which is, however, also generally more expensive to manufacture than the collar of FIG. 2. The bottom rim 10, just as in FIGS. 2 and 5, contacts the underside 11 of the strip 1B.

Figure 5:
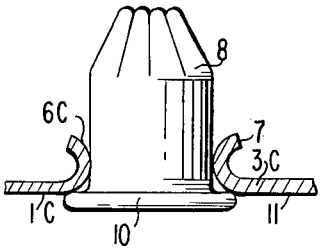

According to the FIG. 5 embodiment, the holding collar 3C is bent outwardly in the zone of its end face 7 by subsequent round flanging, so that the holding collar with its rounded inner surface 6C is in clamping engagement with the propellant charge 8 and/or the case thereof.

Figure 6:
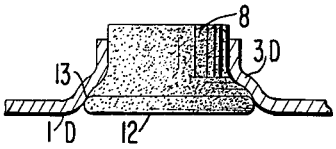
FIG. 6 is a longitudinal partial sectional view of another preferred embodiment of this invention with a caseless propellant charge.

FIG. 6, finally, shows a caseless propellant charge 8 likewise held by the holding collar 3D in the manner of a clamping seat. The propellant charge 8', fashioned for example as a pressed element, additionally rests with its rim 12 on the shoulder 13 of the strip 1D in a direction transversely to the strip 1.

For stud driving tools with propellant cartridges of the usual power, it is contemplated for example to utilize a strip of the aluminum alloy Al Mg Si 1 — F 37 with a thickness of 0.3 – 0.5 mm., a width of 14 mm., a central distance of the cutouts of 12 – 15 mm., with a diameter of the cutouts of 6 – 7 mm. and a height of the bulged holding collar of 0.5 – 3 mm.

While we have shown and described only several embodiments in accordance with the present invention, it is understood that the same is not limited thereto but also contemplates numerous changes and modifications as would be known to those skilled in the art given the present disclosure of the invention, and we therefore do not wish to be limited to the details shown and described herein only schematically but intend to cover all such changes and modifications.

We claim:

1. Magazine apparatus comprising a planar strip of material, a plurality of holes extending transversely through said strip and spaced at intervals along the length of said strip, and a cartridge holding collar for each of said holes, said cartridge holding collar being a deformed portion of said planar strip and extending out of the plane of said strip, each of said collars being configured to securely engage a cartridge inserted through a respective hole in the manner of a clamping seat.

2. Apparatus according to claim 1, wherein each of said collars is configured to securely engage the entire periphery of a cartridge only at a position spaced from the plane of said strip.

3. Apparatus according to claim 2, wherein said strip is a flexible coilable strip of metal.

4. Apparatus according to claim 1, wherein each of said collars is configured to contact the entire periphery of a cartridge at a position spaced from the plane of the strip.

5. Apparatus according to claim 4, wherein said collar defines an opening slightly smaller than the predetermined size of a cartridge and exhibits a spring-back resilience such that a cartridge can be resiliently clamped in position on said strip.

6. Apparatus according to claim 5, wherein said strip is a flexible coilable strip of metal.

7. Apparatus according to claim 1, wherein said strip is a flexible coilable strip of metal.

8. Apparatus accroding to claim 7, wherein said collar is rounded at the plane of contact where the smallest opening is formed thereby and has its end face bent toward the outside away from the opening.

9. Apparatus according to claim 7, wherein said collar is dimensioned to contact a cartridge along a major portion of the length of the collar in the direction of insertion of the cartridge

10. Apparatus according to claim 7, further comprising a cartridge extending through each of said holes, each cartridge including a rim engageable with the strip for limiting the movement of the cartridge in the direction of insertion thereof.

11. Apparatus according to claim 10, wherein said cartridge is a caseless cartridge and wherein said collar is in continuous contact with said cartridge along the length of the cartridge in the direction of insertion thereof.

12. Apparatus according to claim 7, wherein each of said collars exhibits a smaller inside cross-section at its contact plane where it contacts a cartridge than at the plane of the strip such that in use it contacts a cartridge held in place thereby only at the contact plane, said contact plane being spaced from the plane of the strip in the direction of insertion of the cartridge.

13. Apparatus according to claim 12, wherein said collar is provided with a sharp-edge at its contact plane for contacting a cartridge.

14. Apparatus according to claim 12, wherein said collar exhibits a cross-section rounded at its contact plane and with its end face bent toward the outside away from the hole.

15. Apparatus according to claim 12, wherein said collar includes a stepped portion at the plane of the strip for abuttingly holding a rim of a cartridge such that said rim does not project out of the plane of the surface of the strip at the side of the strip opposite the contact plane.

* * * * *

Disclaimer 4,036,103.—*Heinz Gawlick*, Vagen Post Feldkirchen-Westerham, *Horst Rammensee*, Nurnberg, *Karl Mack*, Ansbach, and *Fritz Schneider*, Burgbernheim, Germany. MAGAZINE APPARATUS FOR PROPELLANT CHARGES AND METHOD OF MAKING SAME. Patent dated July 19, 1977. Disclaimer filed Mar. 14, 1978, by the assignees, *Dynamit Nobel Aktiengesellschaft and Impex-Essen Vertrieb Von Werkzeugen GmbH*.

Hereby enter this disclaimer to the entire term of said patent.

[*Official Gazette May 23, 1978.*]